US009466206B2

(12) United States Patent
Pichard et al.

(10) Patent No.: US 9,466,206 B2
(45) Date of Patent: Oct. 11, 2016

(54) ALARM TRIGGERING DEVICE FOR A SECURITY SYSTEM AND METHOD FOR INSTALLING AN ALARM TRIGGERING DEVICE

(75) Inventors: Laurent Pichard, Frichemesnil (FR); Stephane Dimarco, Cergy (FR); Jacques Lewiner, Saint-Cloud (FR)

(73) Assignee: FINSECUR, Nanterre (FR)

( * ) Notice: Subject to any disclaimer, the term of this patent is extended or adjusted under 35 U.S.C. 154(b) by 35 days.

(21) Appl. No.: 14/007,825

(22) PCT Filed: Mar. 29, 2012

(86) PCT No.: PCT/FR2012/000113

§ 371 (c)(1),
(2), (4) Date: Sep. 26, 2013

(87) PCT Pub. No.: WO2012/131189

PCT Pub. Date: Oct. 4, 2012

(65) Prior Publication Data

US 2014/0009281 A1 Jan. 9, 2014

(30) Foreign Application Priority Data

Mar. 31, 2011 (FR) ..... 11/00947

(51) Int. Cl.

| | |
|---|---|
| ***G08B 1/08*** | (2006.01) |
| ***G08B 29/02*** | (2006.01) |
| ***G08B 25/10*** | (2006.01) |
| *G08B 29/06* | (2006.01) |

(52) U.S. Cl.

CPC ..... *G08B 29/02* (2013.01); *G08B 25/10* (2013.01); *G08B 29/06* (2013.01)

(58) Field of Classification Search

USPC ..... 340/635, 539.21, 539.14, 539.16, 539.1

See application file for complete search history.

(56) References Cited

U.S. PATENT DOCUMENTS

| | | | |
|---|---|---|---|
| 2,987,712 | A | 6/1961 | Olyzou |
| 3,909,722 | A | 9/1975 | Bennett, Jr. |
| 3,942,166 | A | 3/1976 | Peral et al. |
| 4,064,507 | A | 12/1977 | Schmitz |
| 4,141,007 | A | 2/1979 | Kavasilios et al. |

(Continued)

FOREIGN PATENT DOCUMENTS

| | | | |
|---|---|---|---|
| EP | 1 477 951 | A2 | 11/2004 |
| WO | 2005/013228 | A1 | 2/2005 |

OTHER PUBLICATIONS

International Search Report, dated Jun. 1 2012, from corresponding PCT application.

*Primary Examiner* — Travis Hunnings

(74) *Attorney, Agent, or Firm* — Young & Thompson

(57) ABSTRACT

An alarm triggering device (200) for a security system (10), includes an interface (210) arranged so as to connect the alarm triggering device (200) to a device for managing the security system (100) via a wireless connection (50); triggering elements (220) for triggering an alarm in the case of a pre-determined event; elements for controlling the wireless connection (240) in order to check, during an alarm triggering device installation step, the quality of the wireless connection between the alarm triggering device and the management device; and signalling elements (250) for signaling, to the alarm triggering device, an indication of the quality of the wireless connection between the alarm triggering device and the management device during the alarm triggering device installation step.

21 Claims, 5 Drawing Sheets

(56) References Cited

U.S. PATENT DOCUMENTS

| | | | | |
|---|---|---|---|---|
| 4,191,947 | A | 3/1980 | Bouchard et al. | |
| 5,151,682 | A | 9/1992 | Marinitsch | |
| 5,822,373 | A | 10/1998 | Addy | |
| 5,936,524 | A | 8/1999 | Zhevelev et al. | |
| 6,157,307 | A | 12/2000 | Hardin | |
| 6,346,983 | B1 | 2/2002 | Yufa | |
| 6,492,901 | B1 | 12/2002 | Ridolfo | |
| 6,624,750 | B1 | 9/2003 | Marman et al. | |
| 6,744,366 | B2 | 6/2004 | How | |
| 6,809,642 | B1 | 10/2004 | Brenner | |
| 7,081,815 | B2 | 7/2006 | Runyon et al. | |
| 7,239,236 | B1 * | 7/2007 | Britton | 340/514 |
| 7,349,997 | B2 | 3/2008 | Feather, Jr. et al. | |
| 7,472,202 | B2 | 12/2008 | Parupudi et al. | |
| 8,284,065 | B2 | 10/2012 | Gonzales | |
| 8,618,942 | B1 | 12/2013 | Billman | |
| 2001/0002793 | A1 | 6/2001 | Woodhead et al. | |
| 2001/0039481 | A1 | 11/2001 | Tremblay et al. | |
| 2002/0049933 | A1 | 4/2002 | Nyu | |
| 2004/0128586 | A1 | 7/2004 | Bahr et al. | |
| 2005/0012629 | A1 | 1/2005 | Shebek et al. | |
| 2005/0013228 | A1 | 1/2005 | Miyamoto et al. | |
| 2005/0083235 | A1 | 4/2005 | Savage et al. | |
| 2005/0264427 | A1 | 12/2005 | Zeng et al. | |
| 2006/0082455 | A1 | 4/2006 | Andres et al. | |
| 2006/0082464 | A1 | 4/2006 | Andres et al. | |
| 2006/0267760 | A1 | 11/2006 | Shecter | |
| 2007/0152809 | A1 | 7/2007 | Berezowski et al. | |
| 2007/0260570 | A1 | 11/2007 | Hinchey et al. | |
| 2008/0094204 | A1 | 4/2008 | Kogan et al. | |
| 2008/0177436 | A1 | 7/2008 | Fortson | |
| 2009/0027229 | A1 | 1/2009 | Fortson et al. | |
| 2009/0147261 | A1 | 6/2009 | Hawkinson et al. | |
| 2009/0163151 | A1 * | 6/2009 | Menden et al. | 455/90.2 |
| 2009/0199855 | A1 | 8/2009 | Davenport | |
| 2009/0212961 | A1 | 8/2009 | McGivern | |
| 2009/0214009 | A1 | 8/2009 | Schuman, Sr. et al. | |
| 2009/0243836 | A1 | 10/2009 | McSheffrey | |
| 2010/0013491 | A1 | 1/2010 | Hooper et al. | |
| 2010/0097733 | A1 | 4/2010 | E. | |
| 2010/0171608 | A1 | 7/2010 | Harkins et al. | |
| 2010/0192695 | A1 | 8/2010 | McSheffrey, Jr. et al. | |
| 2010/0253531 | A1 | 10/2010 | Qiu et al. | |
| 2010/0280635 | A1 * | 11/2010 | Cohn et al. | 700/90 |
| 2010/0302045 | A1 | 12/2010 | Foster | |
| 2011/0111700 | A1 * | 5/2011 | Hackett | 455/41.2 |
| 2011/0160934 | A1 | 6/2011 | Harata | |
| 2012/0029762 | A1 * | 2/2012 | Ubik | G07C 5/008 701/29.6 |
| 2012/0154126 | A1 | 6/2012 | Cohn et al. | |
| 2012/0212139 | A1 | 8/2012 | Gluzman et al. | |
| 2012/0320955 | A1 * | 12/2012 | Ueda et al. | 375/219 |
| 2013/0285808 | A1 | 10/2013 | Piccolo, III | |
| 2014/0002649 | A1 | 1/2014 | Martin et al. | |
| 2015/0097687 | A1 * | 4/2015 | Sloo et al. | 340/632 |

* cited by examiner

ALARM TRIGGERING DEVICE FOR A SECURITY SYSTEM AND METHOD FOR INSTALLING AN ALARM TRIGGERING DEVICE

CROSS REFERENCE OF RELATED APPLICATIONS

This is the 35 USC 371 national stage application of PCT/FR2012/000113 filed Mar. 29, 2012, which claims priority from French Patent Application No. 11 00947 filed Mar. 31, 2011, each of which is herein incorporated by reference in its entirety.

TECHNICAL FIELD OF INVENTION

The present invention relates to an alarm triggering device for a security system (fire detection, intruder detection, detection of operational malfunctions in technical facilities, etc.); and to a security system (fire detection, intruder detection, detection of operational malfunctions in technical facilities, etc.) It applies in particular to fire or intruder detection in public or private residential, industrial, commercial and leisure buildings or to the detection of operational malfunctions in technical facilities. In the following, the term "technical alarm" will be used to mean the detection of operational malfunctions in technical facilities and "predefined event" to mean a fire, intrusion or an operational malfunction in technical facilities or similar.

BACKGROUND OF THE INVENTION

Regarding fire detection, a fire detection system comprises an electronic central monitoring station and a detection network that communicates with the electronic control unit including one or more alarm triggering devices or fire detection points. These alarm triggering devices or detection points may comprise automatic fire detectors able to sense a phenomenon representative of a fire and manual fire detectors (manual triggers), which can be operated by a person discovering a fire situation. Alarm triggering devices are in general distributed in the area or areas to be monitored and connected to the central monitoring station. The electronic control unit makes it possible to monitor the area or areas to be monitored by means of the alarm triggering devices and to broadcast an alarm when a fire is detected.

The alarm triggering devices are connected to the central monitoring station so as to allow information to be exchanged between the control unit and said alarm triggering devices, so that the control unit is kept informed of the status of each element of the detection network and, if applicable, so as to control them.

Fire detection systems are known in which the alarm triggering devices are connected to the control unit by means of a wireless connection. To ensure reliable and safe monitoring, a high-quality link between each alarm triggering device and the control unit is important so as to enable information exchanges. However, the quality of the link can be degraded, for example, because of the presence of obstacles in the radio communication path between said alarm triggering device and the control unit.

A radio communications fault can be very dangerous when a fire breaks out, since the alarm triggering device would be unable to communicate with the central monitoring station to signal that the alarm has been triggered and the presence of a fire.

Positioning the triggering devices in relation to the central monitoring station is a very important factor to ensure a high quality wireless connection between the two elements. Such positioning, carried out during the installation of the fire detection system, is complicated to achieve as it requires the quality of the wireless communications with the control unit to be checked. This is a cause of wasted time, significant costs overruns and risks of badly-realized installations.

The same drawbacks as those described above can also be found when an intrusion detection system or an operational malfunction detection system for technical facilities is under consideration.

OBJECT AND SUMMARY OF THE INVENTION

The present invention aims to remedy all or part of the drawbacks described above.

To this end, according to a first aspect, the present invention envisages an alarm triggering device for a security system, the alarm triggering device comprising: an interface arranged so as to connect the alarm triggering device to a security system control device (frequently known as control unit or central monitoring station) by means of a wireless connection; triggering means to trigger an alarm if a predefined event occurs; means of checking the quality of the wireless connection to verify, during an installation step of the alarm triggering device, the quality of the wireless connection between said alarm triggering device and the management device; and signaling means to signal an indication of the quality of the wireless connection between said alarm triggering device and the management device during the installation step of said alarm triggering device.

According to an embodiment, the verification means are arranged so as to measure a parameter representative of the reception quality of a predefined radio verification signal coming from said management device.

According to an embodiment, the verification means are arranged to measure the signal-to-noise ratio or the intensity of the predefined radio verification signal. Hereinafter, "intensity" will mean any parameter representative of the quality of information transmission by the radio link, such as the signal's amplitude or phase or frequency modulation, for example.

In the following, the expression "quality of the link to the alarm triggering device" will refer to the relative value of the signal-to-noise ratio or of the intensity of the predefined radio verification signal received from the management device in relation to a reference value.

Similarly, in the following, the expression "quality of the link to the management device" will refer to the relative value of the signal-to-noise ratio or of the intensity of a predefined radio verification signal received from the alarm triggering device in relation to a reference value.

Lastly, in the following, the expression "quality of the radio link" will refer either to the relative value of the signal-to-noise ratio or of the intensity of a predefined radio verification signal received from the alarm triggering device or from the management device in relation to a reference value.

According to an embodiment, the signaling means are arranged so as to generate different signals depending on the reception quality of the predefined verification signal.

According to an embodiment, the signaling means are arranged so as to emit a sound signal whose frequency or volume varies depending on the quality of the link towards the alarm triggering device.

According to an embodiment, the signaling means are arranged so as to emit a light signal whose color or intensity varies depending on the quality of the link to the alarm triggering device.

According to an embodiment, the signaling means are arranged so as to emit a blinking light signal whose blink frequency varies depending on the quality of the link to the alarm triggering device.

According to an embodiment, the signaling means are arranged so as to emit a sound signal in the form of impulses whose impulse repeat frequency varies depending on the quality of the link to the alarm triggering device.

According to an embodiment, the impulse repeat frequency increases depending on the increase in quality of the link to the alarm triggering device.

According to an embodiment, the verification means are arranged so as to emit a test radio signal towards the management device; wait for a predefined period of time for a response radio signal from the management device; and measure the intensity or the signal-to-noise ratio of the response radio signal, if the response signal is received.

According to an embodiment, the device may also comprise emission means to emit a predefined verification radio signal to the management device to allow the management device to check the quality of the wireless connection between the management device and the triggering device during the installation step of the triggering device.

A second aspect of the invention envisages a security system comprising a management device able to communicate with at least one alarm triggering device such as that described above.

A third aspect of the invention envisages an installation method for at least one alarm triggering device of a security system in an area to be monitored, with the security system comprising a management device able to communicate with the triggering device by means of a wireless link, with the method comprising the following steps:

- positioning of the alarm triggering device at a first location;
- checking the quality of the wireless connection between the triggering device at the first location and the management device;
- signaling at the location of the triggering device an indication of the quality of the wireless connection between said triggering device and the management device; and
- moving the alarm trigger device to a second location within the area to be monitored to check if the quality of the wireless connection can be improved.

According to an embodiment, the verification step comprises a step of measuring a parameter representative of a predefined radio verification signal coming from said management device.

According to an embodiment, the verification step comprises a step of measuring the signal-to-noise ratio or the intensity of the predefined radio verification signal.

According to an embodiment, the signaling step comprises generating different signals depending on the reception quality of the predefined verification signal.

According to an embodiment, the signaling step comprises emitting a sound signal whose frequency or volume varies depending on the quality of the link to the management device.

According to an embodiment, the signaling step comprises emitting a light signal whose color or intensity varies depending on the quality of the link to the alarm triggering device.

According to an embodiment, the signaling step comprises emitting a blinking light signal whose blink frequency varies depending on the quality of the link to the alarm triggering device.

According to an embodiment, the signaling step comprises emitting a sound signal in the form of impulses whose impulse repeat frequency varies depending on the quality of the link to the alarm triggering device.

According to an embodiment, the impulse repeat frequency increases depending on the increase in quality of the link to the alarm triggering device.

According to an embodiment, the verification step comprises

- transmitting a test signal towards the management device;
- waiting for a predefined period of time for a response signal from the management device; and
- measuring either the intensity or the signal-to-noise ratio of the response, if a response signal is received.

According to another aspect, the present invention envisages an alarm triggering device for a security system, the alarm triggering device comprising: an interface arranged so as to connect the alarm triggering device to a security system control device (frequently known as control unit or central monitoring station) by means of a wireless connection; a trigger to trigger an alarm if a predefined event occurs; a verification unit configured to check the quality of the wireless connection to verify, during a step of installing the alarm triggering device, the quality of the wireless connection between said alarm triggering device and the management device; and a signaling module to signal an indication of the quality of the wireless connection between said alarm triggering device and the management device during the installation step of said alarm triggering device.

Another aspect of the present invention proposes a computer program for implementing at least part of the corresponding method described previously. Such a program may be downloadable from a telecommunications network and/or stored in a memory of a processing device and/or stored on a memory medium designed to cooperate with a processing device.

BRIEF DESCRIPTION OF THE DRAWINGS

In the following, descriptions are provided for a few preferred embodiments of the invention with reference to the figures in an appendix hereto, in non-limiting fashion, of course.

DETAILED DESCRIPTION OF EMBODIMENTS

Figure 1:
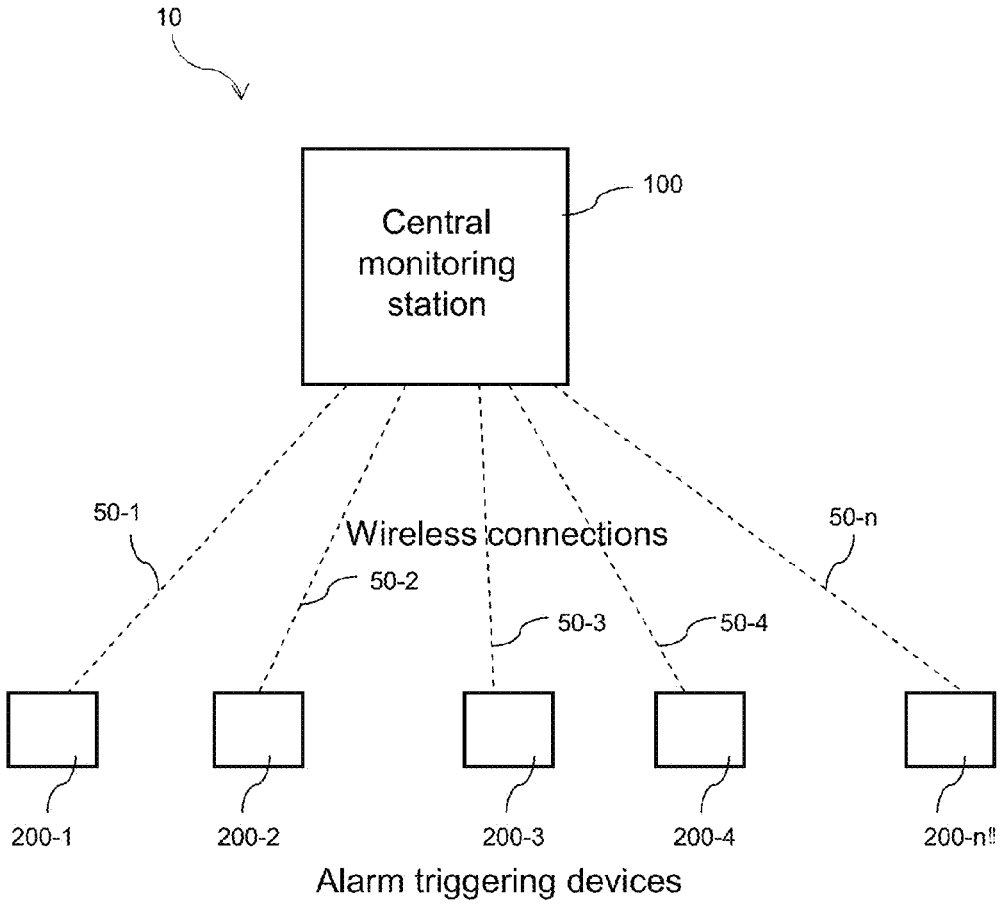
FIG. 1 represents, schematically, elements of a security system according to a first embodiment of the present invention.

A security system 10 according to a first mode of the invention is represented schematically in FIG. 1. This system comprises a central monitoring station 100 able to be connected by means of the wireless connections 50-1 . . .

50-n to several alarm triggering devices 200-1 . . . 200-n, designed to be distributed in an area to be monitored.

Figure 2A:
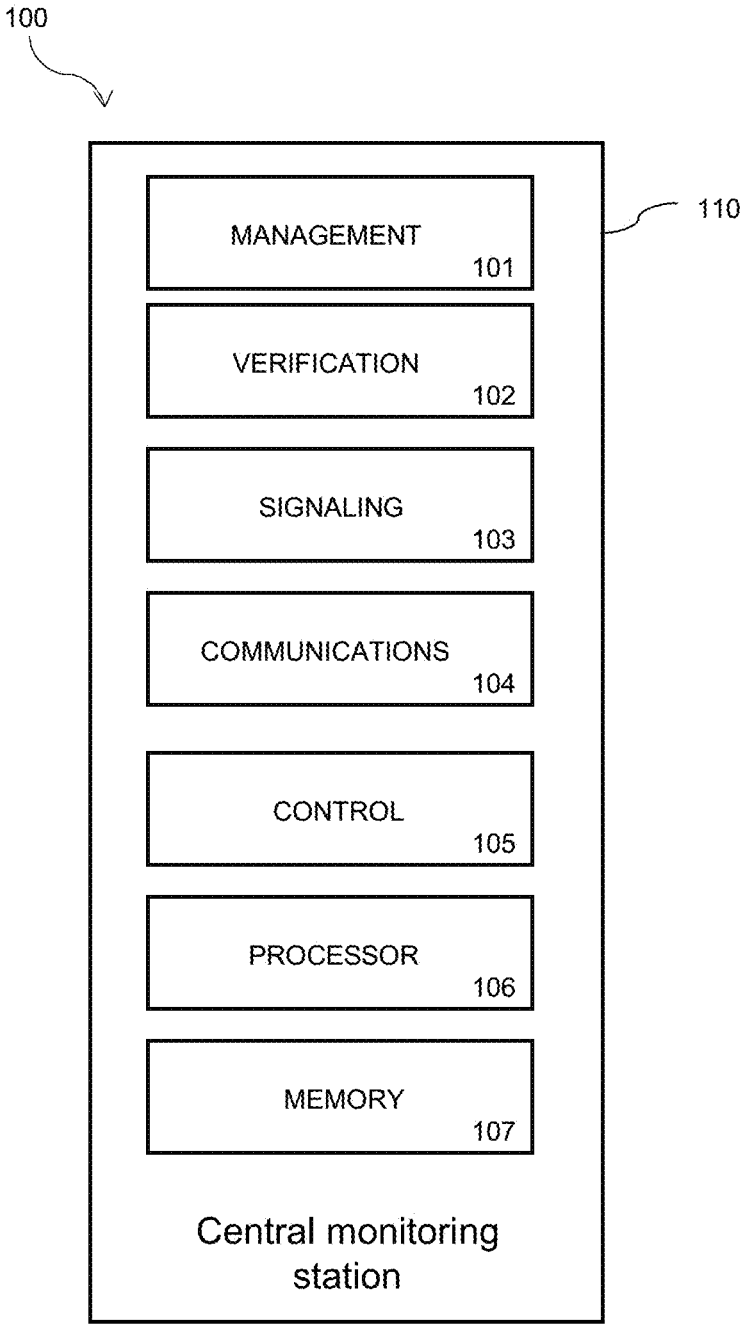
FIG. 2A represents, schematically, a central monitoring station according to a first embodiment of the invention.

In the embodiment illustrated in FIG. 2A, the central monitoring station 100 is realized in a single housing 110 that groups together a set of computerized means of management 101, verification 102, signaling, 103, communications 104 and control 105. The central monitoring station 100 also comprises a processor 106 to manage these means and memory 107 to store the data.

The central monitoring station 100 is configured, in a way known per se, to be able to detect the occurrence of an alarm from any one of the alarm triggering devices 200-1 . . . 200-n, signal the alarm condition by visual and/or audible means and to control said alarm triggering devices 200-1 . . . 200-n. The communications means 104 comprise a wireless interface including a device to receive and transmit radio signals, fitted with an antenna to allow the control unit to communicate with the alarm triggering devices 200-1 . . . 200-n by means of the wireless connections 50-1 . . . 50-n.

Figure 2B:
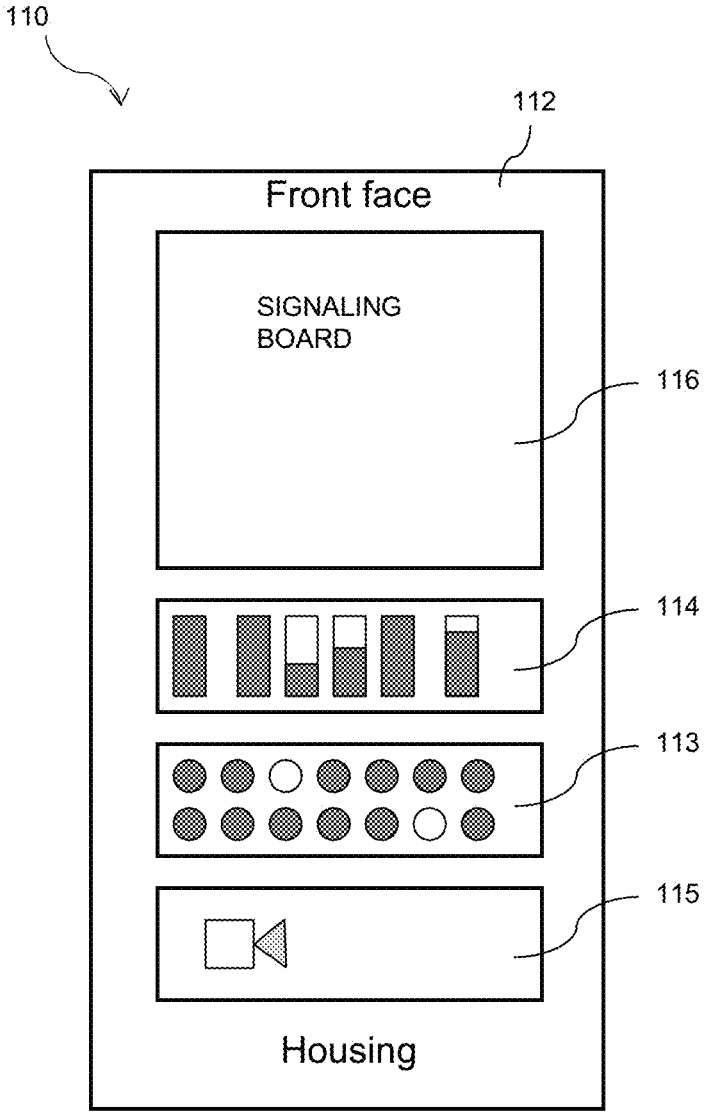
FIG. 2B represents, schematically, the front face of a central monitoring station housing according to a first embodiment of the invention.

FIG. 2B shows the front face 112 of the housing 110 of the central monitoring station 100 comprising alarm indicators 113, each of which represents, in a manner known per se, the alarm status of the alarm triggering devices of the predefined event monitoring system, e.g. a fire. The front face 112 also comprises connection indicators 114, each of which indicates the quality of the wireless connection between the central monitoring station 100 and a corresponding alarm trigger device, a sound emitter 115 and a display screen 116. The sound emitter 115 is of a type known, for example, in fire alarms and is designed to emit an audible alarm signal. Each connection indicator 114 can correspond to a different triggering device 200-i.

The housing 110 can be fitted, in a way known per se, with means enabling a connection towards central monitoring and control means, via a telephone line, the Internet or other means.

The display screen 116 allows the processor to display visual messages aimed at a user of the central monitoring station 100 and/or at a member of the maintenance team for this device. In particular, the display screen 116 is designed to display an alarm indication and/or an indication of the status of a wireless connection 50 between the central monitoring station 100 and one or more triggering devices 200.

In some embodiments, information concerning the verification signal's reception quality may be displayed on the signaling board 116 of the central monitoring station 100.

The alarm triggering devices 200-1 . . . 200-n include automatic triggers comprising predefined event detectors and manual triggers. The automatic predefined event detectors are able to sense a phenomenon representative of a predefined event, e.g. for a fire, smoke or flames. These detectors can be configured to detect a variation in a physical or chemical dimension, for example, in a non-limiting way, a temperature, a presence of smoke particles or a composition of the air and when this variation matches predefined criteria, e.g. amplitude, derivative or second derivative, said detector transmits a signal representative of a predefined event's detection to the central monitoring station 100 by means of the wireless connections 50-i. The automatic triggers trigger an alarm in response to the detection of a phenomenon representative of a predefined event. The manual triggers can be operated manually by a person discovering a predefined event situation, e.g. a fire. In response to the triggering, an alarm signal is transmitted to the central monitoring station 100. In some embodiments of the invention, an alarm signal can be signaled at the location of the alarm triggering device.

Figure 3:
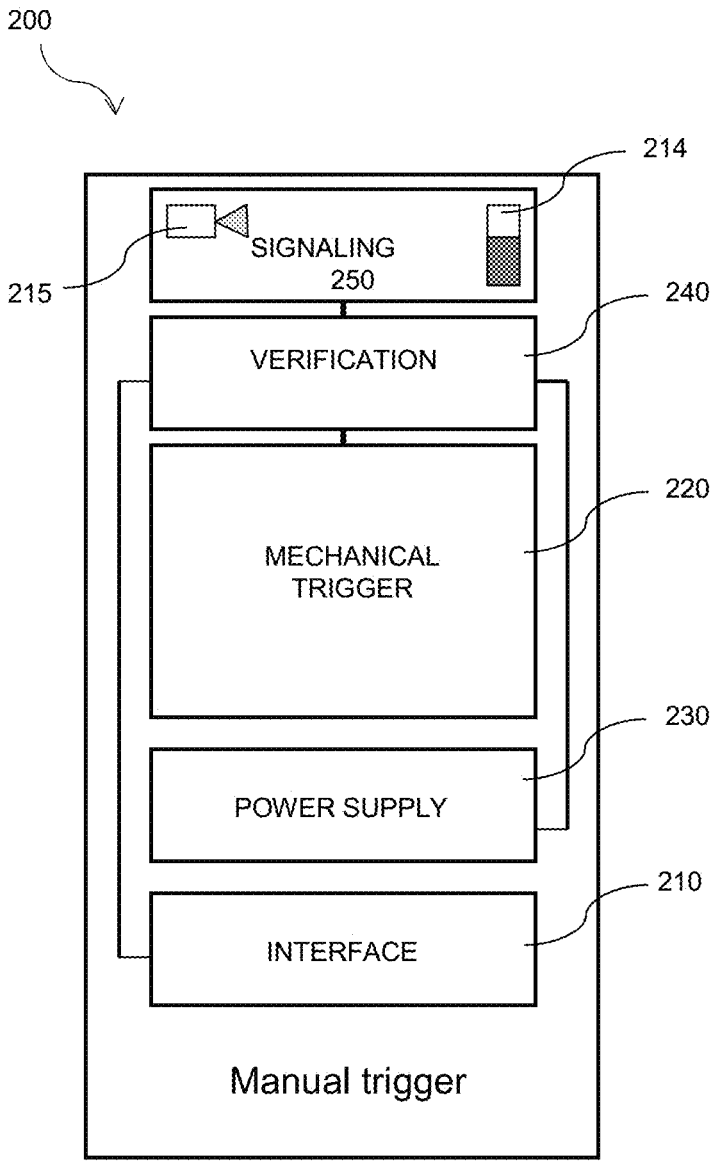
FIG. 3 represents, schematically, a manual trigger according to a first embodiment of the invention.

An alarm triggering device 200 for the security system, according to a first embodiment of the invention, is represented schematically in FIG. 3. The alarm triggering device in this embodiment is a manual trigger 200. This manual trigger comprises: a wireless interface 210 to connect the manual trigger 200 to the security system's central monitoring station 100 by means of the wireless connection 50; a mechanical trigger 220 such as a push-button with one or two stable balanced positions to allow a user to trigger an alarm manually in case of a predefined event, e.g. a fire; a power supply battery 230 to power the manual trigger 200; verification means 240 to verify the wireless connection 50 between the manual trigger 200 and the central monitoring station 100; and signaling means 250. The signaling means 250 can be arranged to signal, at the location of the manual trigger 200, an alarm signal when the mechanical trigger 220 is triggered. In another embodiment, an alarm device can be provided in the manual trigger 200 to generate an alarm signal in case of an operating fault when a test button is operated.

The verification means 240 are connected to the wireless interface 210. They are configured so as to verify the quality of a wireless connection 50-i between the central monitoring station 100 and the manual trigger 200-i during the latter's installation within the area to be monitored 500. To this end, the verification means 240 can be configured so as to measure the intensity of the radio signal received from the central monitoring station 100 through the wireless interface 50-i and to compare the measured intensity with a predefined intensity threshold. The verification means 240 can be configured so as to measure, as an alternative or in addition, the signal-to-noise ratio of the radio signal received from the central monitoring station 100 through the wireless interface 210 and to compare the measured signal-to-noise ratio to a predefined signal-to-noise ratio threshold.

In a particular embodiment, the verification means 240 can be configured so as to send a test signal to the central monitoring station 100 during the installation of the manual trigger and to wait for a response signal coming from the central monitoring station 100 so as to verify the wireless connection 50. The intensity and/or the signal-to-noise ratio of the response signal coming from the central monitoring station 100 can then be measured to determine the quality of the wireless connection 50-i between the central monitoring station 100 and the triggering device 200-i. When weak intensity and/or a weak signal-to-noise ratio is detected, the trigger device 200-i can be moved to another location within the area to be monitored so as to improve the quality of the wireless connection 50-i. The absence of a response signal from the central monitoring station 100 may indicate the absence of wireless communications. In this case, the trigger device 200-i can be moved within the area to be monitored so as to find a location that allows improved wireless communications between the two devices.

In this embodiment, the signaling means 250 are configured so as to generate different signals depending on the reception quality of the verification or response radio signal coming from the central monitoring station 100. For example, the signaling means 250 can be configured to manage the light emissions of a connection indicator 214 such that the color of the power supply indicator varies depending on the intensity or the signal-to-noise ratio of the verification or response signal received from the central monitoring station.

In variants, the brightness of the light from the indicator 214 can vary depending on the intensity or the signal-to-noise ratio of the verification or response signal received. In other variants, the signaling means 250 can be configured to manage the indicator's blink frequency depending on the intensity or the signal-to-noise ratio of the verification or response signal received. In an embodiment, the indicator can comprise several emission elements and the number of emission elements lit can vary depending on the intensity or the signal-to-noise ratio of the verification or response signal received.

In other variants, the signaling means 250 can generate a sound signal whose volume or frequency varies depending on the intensity or the signal-to-noise ratio of the verification or response signal received.

Different sounds can be emitted depending on the quality of the wireless connection 50 or the emission frequency of these sounds can vary depending on the quality of the wireless connection 50 or these sounds can be emitted in the form of impulses at repeat frequencies that depend on the quality of the wireless connection 50. In a particular embodiment, the repeat frequency increases depending on the improvement in the quality of the wireless connection. In another embodiment, the repeat frequency decreases depending on the improvement in the quality of the wireless connection.

It should be noted that the device described above makes it possible to facilitate the installation of the triggering devices. Effectively, once the control unit has been installed, it is possible to place the triggering devices in positions such that the signaling means are not in a malfunction alarm condition. For example, if they are arranged so as to emit a sound signal in the form of impulses at repeat frequencies that get correspondingly lower as the radio link's quality decreases, then the person installing the triggering device has a directly perceptible piece of information. It would, of course, be possible to emit impulses at repeat frequencies that get correspondingly higher as the radio link's quality decreases.

Figure 4:
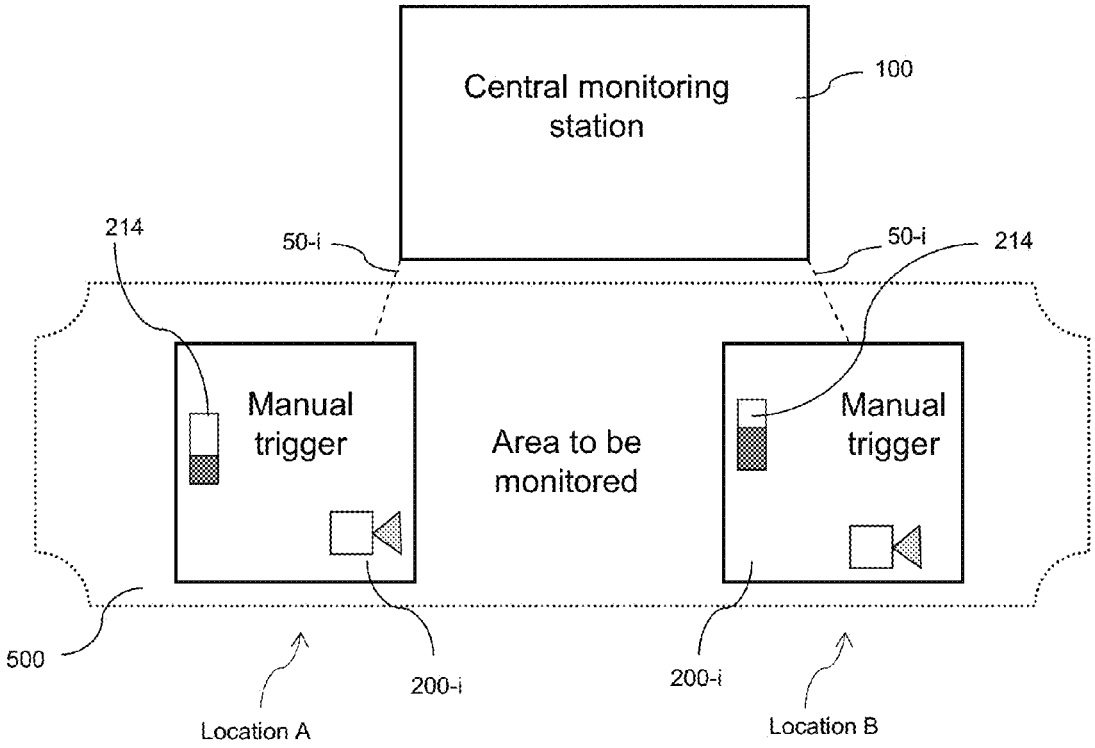
FIG. 4 represents, schematically, the installation of a triggering device according to one or more embodiments of the invention.

With reference to FIG. 4, during the installation of a manual trigger 200-i in the area to be monitored 500, the quality of the connection 50-i between the manual trigger 200-i and the central monitoring station 100 is first checked when the manual trigger 200-i is placed at position A. To achieve this, the manual trigger 200 transmits a test signal to the central monitoring station 100 and waits, for a predefined period of time, for a response signal from the central monitoring station 100. The intensity and/or the signal-to-noise ratio of the response signal from the central monitoring station 100 is measured and compared to a predefined threshold to determine the quality of the wireless connection 50-*i* between the central monitoring station 100 and the manual trigger 200-i. A display 214, representative of the quality of the connection on the trigger, lights a number of light elements depending on the intensity of the response signal received. When weak intensity and/or a weak signal-to-noise ratio or an absence of response signal is detected, the manual trigger 200-i is moved from location A to another location within the area to be monitored 500 and the wireless connection 50-i is checked in the same way to determine whether the quality of the connection at location B has been improved in comparison with the quality of the wireless connection 50-i achieved at location A. The display 214, representative of the quality of the connection, lights more or fewer light elements depending on the intensity of the response signal received from the central monitoring station 100 when the manual trigger is at location B. In this way, the manual trigger 200-i may be placed at several locations so as to find a location among several locations within the area to be monitored 500 that enables optimum wireless communication with the central monitoring station 100. This method can be repeated for the installation of each alarm triggering device.

The ability to test the wireless connection at the time of installation makes it possible to optimize the positioning of each triggering device within the area to be monitored. Consequently, the installer of the trigger device is informed of the quality of the wireless connection at the time of the installation.

Obviously and as is demonstrated moreover in the preceding description, the invention is in no way limited to these two modes of application and embodiments that were more specifically envisaged; on the contrary, it encompasses all the variants without in any way departing from the scope of the invention, such as it is defined by the claims.

For example, in variants, the central monitoring station may comprise means of checking the quality of the wireless connection to verify, during the installation step, the quality of the wireless connection between said triggering device and the central monitoring station; and signaling means to signal an indication of the quality of the wireless connection to the management device, i.e. between said alarm triggering device and the central monitoring station 100. In this way, the quality of the connection can be checked in both directions. The central monitoring station can thus send, to the alarm triggering device, a specific message relating to the quality of the wireless connection to the management device. When the alarm trigger device receives this message, the signaling means 103 can be activated to emit a visual or sound signal.

In addition, even though the embodiments were described in relation to positioning a manual trigger, it will be readily understood that, in other embodiments, the positioning of the automatic fire detectors or of other types of alarm triggering devices can be checked.

The invention claimed is:

1. An alarm triggering device for a security system, the alarm triggering device comprising:

an interface configured to connect the alarm triggering device to a management device of the security system by means of a wireless connection for transmission of an alarm signal to the management device;

at least one trigger that triggers an alarm in case a predefined event occurs;

a verification device that verifies, during a step of installing the alarm triggering device within an area to be monitored, the quality of the wireless connection between said alarm triggering device and the management device for transmission of the alarm signal, the verification device configured to emit, during the installing step, a test radio signal towards the management device, to wait for a predefined time period for a response radio signal from the management device, and in the case where the response radio signal is received, to measure the intensity or the signal-to-noise ratio of the response radio signal to verify the quality of the wireless connection for transmission of the alarm signal;

at least one signaling device that signals, at the location of the alarm triggering device, an indication of the quality of the wireless connection between said alarm triggering device and the management device during the installation step of said alarm triggering device; and a test button;

wherein, in response to the test button being pressed, the verification device operates to verify the quality of the wireless connection, and the signaling operates to signal an operating fault in the case where an operating fault is detected when the test button is operated.

2. The device according to claim 1, wherein the verification device is configured to measure a parameter representative of the reception quality of a predefined radio verification signal coming from said management device.

3. The device according to claim 2, wherein the verification device is configured to measure the signal-to-noise ratio or the intensity of the predefined radio verification signal.

4. The device according to claim 1, wherein the signaling device is configured to generate different signals depending on the quality of the wireless connection.

5. The device according to claim 4, wherein the signaling device is configured to emit a light signal having a color, intensity or blinking frequency that varies depending on the quality of the link to the alarm triggering device.

6. The device according to claim 4, wherein the signaling device is configured to emit a sound signal in the form of impulses having a volume, frequency or impulse repeat frequency that varies depending on the quality of the link to the alarm triggering device.

7. The device according to claim 1, further comprising:

an emitter that emits a predefined verification radio signal to the management device to allow the management device to check the quality of the wireless connection between the management device and the triggering device during the installation of the triggering device.

8. A fire detection system comprising at least one alarm triggering device according to claim 1, and a management device able to communicate with said at least one alarm triggering device.

9. An installation method for an alarm triggering device of a security system in an area to be monitored, where the security system has a management device that communicates with the triggering device by means of a wireless link, the method comprising:

in response to an actuation of a test button, verifying a quality of a wireless connection, between the triggering device and the management device, for transmission of an alarm signal to the management device, where the triggering device is positioned at a first location within the area to be monitored, wherein the verifying includes at least the following sub-steps:

emitting a test radio signal towards the management device;

waiting for a predefined time period for a response radio signal from the management device;

measuring, in the case where the response radio signal is received, any of an intensity and a signal-to-noise ratio of the response radio signal; and signaling, at the location of the triggering device, an indication of the quality of the wireless connection between said triggering device and the management device, and wherein the verifying is repeated in response to an actuation of a test button when the alarm trigger device is positioned at a second location within the area to be monitored, to check if the quality of the wireless connection can be improved.

10. The method according to claim 9, wherein the verifying further comprises a step of measuring a parameter representative of a predefined radio verification signal coming from said management device.

11. The method according to claim 9, wherein the verifying further comprises a step of measuring the signal-to-noise ratio or the intensity of the predefined radio verification signal.

12. The method according to claim 9, wherein the signaling further comprises generating different signals depending on the quality of the wireless connection.

13. The method according to claim 12, wherein the signaling further comprises emitting a sound signal having a frequency or volume that varies depending on the quality of the radio link.

14. The method according to claim 12, wherein the signaling further comprises emitting a light signal having a color or intensity that varies depending on the quality of the radio link.

15. The method according to claim 12, wherein the signaling further comprises emitting a blinking light signal having a blink frequency that varies depending on the quality of the radio link.

16. The method according to claim 12, wherein the signaling further comprises emitting a sound signal in the form of impulses having an impulse repeat frequency that varies depending on the quality of the radio link.

17. The method according to claim 16, wherein the impulse repeat frequency of the impulses increases depending on the increase in the quality of the radio link.

18. A computer program product, comprising any of a memory device in connection with a processing device and/or a non-transitory computer-readable memory medium, having stored thereon program code that, upon execution by the processing device, causes the processing device to execute the steps of the method according to claim 9.

19. A management device of a security system that includes one or more alarm triggering devices, the management device comprising:

an interface, configured to connect the management device to an alarm triggering device of the security system via a wireless connection, for reception of an alarm signal from the alarm triggering device;

at least one alarm indicator that indicates an alarm upon reception of an alarm signal from the alarm triggering device;

a signaling device that indicates a quality of the wireless connection between the management device and the alarm triggering device; and a verification device that verifies, for installation of the alarm triggering device within an area to be monitored, a quality of the wireless connection between the alarm triggering device and the management device for reception of the alarm signal from the alarm triggering device, wherein the verification device is configured to receive a test radio signal from the alarm triggering device, send, within a predefined time period and in response to reception of the test radio signal, a response radio signal to the alarm triggering device, and enable the alarm triggering device to measure the intensity or the signal-to-noise ratio of the response radio signal to verify the quality of the wireless connection between the management device and the alarm triggering device.

20. The device according to claim 19, wherein the verification device is configured to receive a predefined verification radio signal from the alarm triggering device, and verify, based on the received signal, the quality of the wireless connection between the management device and the alarm triggering device, and wherein the signaling device is configured to indicate the quality of the wireless connection between the management device said alarm triggering device.

21. A security system, comprising:

a management device; and an alarm triggering device, said management device comprising:

a first interface, configured to connect the management device to the alarm triggering device via a wireless connection for reception of an alarm signal from the alarm triggering device;

at least one alarm indicator that indicates an alarm upon reception of an alarm signal from the alarm triggering device;

a signaling device that indicates a quality of the wireless connection between the management device and the alarm triggering device; and a first verification device that verifies, for installation of the alarm triggering device within an area to be monitored, a quality of the wireless connection between the alarm triggering device and the management device for reception of the alarm signal from the alarm triggering device, wherein the verification device is configured to receive a test radio signal from the alarm triggering device, send, within a predefined time period and in response to reception of the test radio signal, a response radio signal to the alarm triggering device, and enable the alarm triggering device to measure the intensity or the signal-to-noise ratio of the response radio signal to verify the quality of the wireless connection between the management device and the alarm triggering device;

and said alarm triggering device comprising:

a second interface configured to connect the alarm triggering device to the management device by means of the wireless connection for transmission of the alarm signal to the management device;

at least one trigger that triggers an alarm in case a predefined event occurs;

a second verification device that verifies, during a step of installing the alarm triggering device within an area to be monitored, the quality of the wireless connection between said alarm triggering device and the management device for transmission of the alarm signal, the verification device configured to emit, during the installing step, the test radio signal towards the management device, to wait for the predefined time period for a response radio signal from the management device, and in the case where the response radio signal is received, to measure the intensity or the signal-to-noise ratio of the response radio signal to verify the quality of the wireless connection for transmission of the alarm signal;

at least one signaling device that signals, at the location of the alarm triggering device, an indication of the quality of the wireless connection between said alarm triggering device and the management device during the installation step of said alarm triggering device; and a test button;

wherein, in response to the test button being pressed, the verification device operates to verify the quality of the wireless connection, and the signaling operates to signal an operating fault in the case where an operating fault is detected when the test button is operated.

* * * * *